United States Patent [19]

Goppelt et al.

[11] Patent Number: 4,721,076

[45] Date of Patent: Jan. 26, 1988

[54] SELF-ADJUSTING HYDRAULIC VALVE TAPPET

[75] Inventors: Dieter Goppelt, Aurachtal; Dieter Schmidt, Nuremberg, both of Fed. Rep. of Germany

[73] Assignee: INA Walzlager Schaeffler KG, Fed. Rep. of Germany

[21] Appl. No.: 930,767

[22] Filed: Nov. 14, 1986

[30] Foreign Application Priority Data

Nov. 29, 1985 [DE] Fed. Rep. of Germany ..... 3542192

[51] Int. Cl.[4] ..... F01L 1/14

[52] U.S. Cl. ..... 123/90.55; 123/90.57

[58] Field of Search ..... 123/90.55, 90.53, 90.56, 123/90.58, 90.52, 90.48, 90.57, 90.59, 90.46, 90.43, 90.51; 29/156.7 B

[56] References Cited

U.S. PATENT DOCUMENTS

| | | | |
|---|---|---|---|
| 4,579,094 | 4/1986 | Doppling et al. | 123/90.55 |
| 4,602,409 | 7/1986 | Schaeffler | 123/90.48 |
| 4,648,360 | 3/1987 | Schaeffler | 123/90.55 |

FOREIGN PATENT DOCUMENTS

| | | | |
|---|---|---|---|
| 2929890 | 12/1981 | Fed. Rep. of Germany | 29/156.7 B |
| 3437478 | 4/1986 | Fed. Rep. of Germany | 123/90.55 |

*Primary Examiner*—Craig R. Feinberg
*Assistant Examiner*—M. Macy
*Attorney, Agent, or Firm*—Bierman and Muserlian

[57] ABSTRACT

A self-adjusting hydraulic valve tappet arranged in a guide bore of a cylinder head of an ice being located between a cam of a cam shaft and an end of a valve stem, the tappet comprising a cup shaped housing (1) closed at one end by an end member (3) against the outside of which the cam abuts and a cylindrical guide sleeve (6) concentric with a cylindrical wall (2) and arranged at its end away from member (3) in the center of an annular flange element (5) which at its outer circumference merges into the cylindrical wall (2) of the housing (1) and guide sleeve (6) is spaced at an opposite end from end member (3), a self-adjusting hydraulic play compensating element (10) being guided for longitudinal movement in the guide sleeve (6) comprising an inner piston (12) and an outer piston (11), the two pistons telescoping and defining oil pressure chamber (22) which communicates through a bore in the inner piston (12) closed by a check valve (21) with a central oil reservoir (13) disposed in inner piston (12), the outer piston (11) being mounted in the guide sleeve (6) and abutting at its closed end against the end of the valve stem, an annular oil reservoir (20) which is supplied with oil from the outside through a bore. A sleeve (17) beginning from end member (3) is sealed at its bottom end against oil reservoir (20) and slidingly engages the outer surface of guide sleeve (6) and extends close to flange element (5) having longitudinal channel (19) is formed between sleeve (17) and guide sleeve (6) to permit oil transfer.

4 Claims, 2 Drawing Figures

SELF-ADJUSTING HYDRAULIC VALVE TAPPET

STATE OF THE ART

Figure 1:
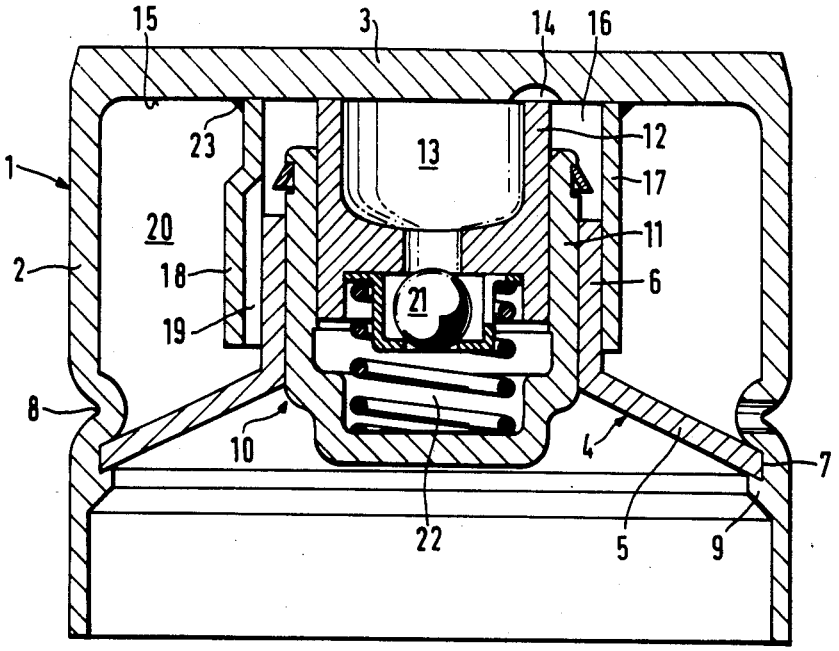

Self-adjusting hydraulic valves arranged in a bore of a cylindrical guide bore of a cylinder head of an internal combustion engine and being contacted at one end face by a cam of a cam shaft and tappet comprises a cup shaped housing having a hollow cylindrical wall closed at one end by an end member against the outside of which the cam abuts and a cylindrical guide sleeve concentric with the cylindrical wall and arranged at its end away from the end member in the center of an annular flange element which at its outer circumference merges into the cylindrical wall of the housing and the guide sleeve is spaced at its other end from the end member, a self-adjusting hydraulic play compensating element being guided for longitudinal movement in the guide sleeve and comprising an inner piston and an outer piston slidingly receiving the inner piston, the two pistons telescoping and defining an oil pressure chamber which communicates through a bore in the inner piston closed by a check valve with a central oil reservoir disposed in the inner piston defined by inner surface of the end member and the wall of the inner piston which abuts against the inner surface, the outer piston is mounted for longitudinal movement in the guide sleeve and abuts at its closed end against the end of the valve stem, an annular oil reservoir defined by a hollow cylindrical wall, a guide sleeve, a hydraulic play compensating element, an end member and flange element and supplied with oil from the outside through a bore, a sleeve beginning from the end member is sealed at its bottom end against the oil reservoir and engages the outer surface of the guide sleeve and extends close to the flange element are known.

In this known construction, the sleeve standing from the end member surrounds the guide sleeve with radial play on all sides so that an oil channel of annular cross-section results between the two structured elements. This construction has the advantages that the oil supplied to the central oil reservoir is drawn in at a low point of the outer annular oil reservoir which ensures that air accumulated inthe upper portion of the outer annular oil reservoir cannot be sucked into the central oil reservoir. However, the annular form of the oil channel formed between the guide sleeve and the sleeve starting from the end member is disadvantageous as shown in the following instance. If a valve tappet is installed without oil filling or if it is evacuated by unfavorable operating conditions, it requires a prolonged period of time before this large volume oil channel is completely filled and only then is the central oil reservoir capable of being supplied with oil. During this relatively long time period, the familiar unpleasant rattle occurs which is an annoyance.

Moreover, in most installation cases, the valve tappets are installed in a sloping position whereby oil can be drawn from the outer annular oil reservoir through the annular oil channel only after the highest point of the inclined lower edge of the sleeve from the end member is covered by the oil in the outer annular reservoir. Should this outer oil reservoir become partially empty, such as during a standstill phase, it may take considerable time for it again to fill with oil sufficiently to completely cover the annular intake cross-section of the oil channel which can then continuously supply the central oil reservoir with oil (DEO No. 65508/84).

OBJECTS OF THE INVENTION

It is an object of the invention to provide a novel self-adjusting hydraulic valve tappet by a single construction to maintain the advantages of the prior construction without the disadvantages thereof.

This and other objects and advantages of the invention will become obvious from the following detailed description.

THE INVENTION

The novel self-adjusting hydraulic valve tappet of the invention is arranged in a guide bore of a cylinder head of an internal combustion engine and is contacted at one end face by a cam of a cam shaft and has a second end face which bears against the end of a valve stem, the tappet comprising a cup shaped housing (1) comprised of a hollow cylindrical wall (2) closed at one end by an end member (3) against the outside of which the cam abuts and a cylindrical guide sleeve (6) concentric with the cylindrical wall (2) and arranged at its end away from member (3) in the center of an annular flange element (5) which at its outer circumference merges into the cylindrical wall (2) of the housing (1) and guide sleeve (6) is spaced at its other end from end member (3), a self-adjusting hydraulic play compensating element (10) being guided for longitudinal movement in the guide sleeve (6) and comprising an inner piston (12) and an outer piston (11) slidingly receiving the inner piston (12), the two pistons telescoping and defining oil pressure chamber (22) which communicates through a bore in the inner piston (12) closed by a check valve (21) with a central oil reservoir (13) disposed in inner piston (12) defined by the inner surface (15) of end member (3) and the wall of inner piston (12) which abuts against inner surface (15), the outer piston (11) is mounted for longitudinal movement in the guide sleeve (6) and abuts at its closed end against the end of the valve stem, an annular oil reservoir (20) defined by hollow cylindrical wall (2), guide sleeve (6), hydraulic play compensating element (10), end member (3) and flange element (5) and supplied with oil from the outside through a bore, a sleeve (17) beginning from end member (3) is sealed at its bottom end against oil reservoir (20) and engages the outer surface of guide sleeve (6) and extends close to flange element (5), characterized in that a longitudinal channel (19) is formed at a single point between sleeve (17) and guide sleeve (6) to permit oil transfer from annular oil reservoir (20) into annular space (16) defined by sleeve (17) and inner piston (12).

The construction of the invention solves the prior art problem by providing a longitudinal channel formed at a single point of the circumference between the sleeve emanating from end member (3) and guide sleeve (6) whereby oil transfer from the annular outer oil reservoir into an inner annular reservoir defined by the sleeve and the inner piston. Since the cross-section of the longitudinal channel is reduced to a small fraction of the cross-section of the annular oil channel of the known tappet, very rapid filling with oil is achieved even in the evacuated state. Moreover, even if the tappet is installed in an oblique position and the tappet rotates in operation about its longitudinal axis, it will statistically be in the highest possible position, only rarely at which point it would suffer the disadvantage of the known tappets. In the great majority of instances of operation, the longitudinal channel of the invention will be in a more favorable position during a stand still phase.

Figure 2:
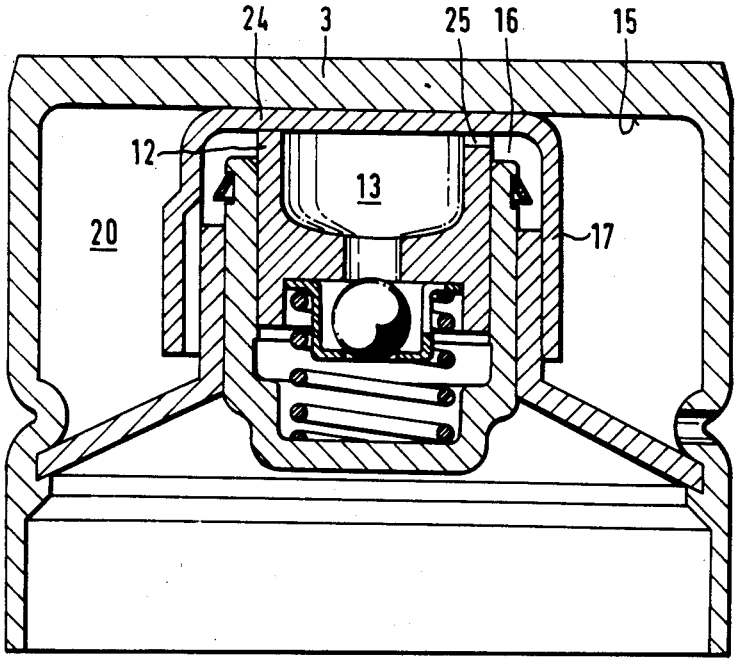

Referring now to the drawings:

FIGS. 1 and 2 are longitudinal cross-sections of two different embodiments of self-adjusting hydraulic valve tappets of the invention.

In FIG. 1, the tappet is comprised of a cup-shaped housing (1) consisting of hollow cylindrical wall (2) and end member (3) in an integral element. An inner element (4) is disposed in housing (1), and element (4) is formed by flange element (5) and guide sleeve (6). At the contact point (7) between the outer circumference of flange element (5) and hollow-cylindrical wall (2), the said elements are firmly secured together by crimping. Additional welding, soldering or like is possible to ensure a liquid-proof anion at this point. For the joining purpose, the flange element (5) bears against the circumferential groove (8) formed in the hollow cylindrical wall (2).

Hydraulic play-compensating element (10) is mounted inthe bore of guide sleeve (6) and is comprised of outer piston (11) which is slidingly guided in guide sleeve (6) and slidingly receives inner piston (12) with little play. Inner piston (12) has a central oil reservoir (13) at its end toward end member (3) which is in communication via cut-out (14) in the inner surface (15) of end member (3) with an annular space (16) defined by inner piston (12) and sleeve (17) emanating from end member (3) and extending over cylindrical guide (6) and terminating near flange element (5). Sleeve (17) is dimensioned so that its bore externally embraces guide sleeve (6) and has at at least one point of its circumference a trough-like formation (18) extending in a longitudinal direction to define together with guide sleeve (6) a longitudinal channel (19) through which oil is transferred from outer annular reservoir (20) into annular space (16) and then into central oil reservoir (13). From there, the oil is guided via check valve (21) into high-pressure oil chamber (22) by known means. Sleeve (17) may be secured to inner surface (15) of end member (3) by weld (23) to ensure that annular space (16) is sealed from annular oil reservoir (20).

In the variation of FIG. 2, the only difference from the embodiment of FIG. 1 is that sleeve (17) is provided with closed end (24) at the end towards end member (3) which makes its unnecessary to seal sleeve (17) from the annular oil reservoir (20) by welding, glueing, soldering or the like. Instead, sleeve (17) with its closed end (24) is merely loosely placed in position since during the operation, it is pressed against inner surface (15) of end member (3) by inner piston (12). A cutout (25) is provided at at least one point of the circumference of inner piston (12) at end member (3) to ensure oil transfer from annular space (16) into central oil reservoir (13).

Various modifications of the valve tappet of the invention may be made without departing from the spirit or scope thereof and it is to be understood that the invention is intended to be limited only as defined in the appended claims.

What we claim is:

1. A self-adjusting hydraulic valve tappet arranged in a guide bore of a cylinder head of an internal combustion engine and being contacted at one end face by a cam of a cam shaft and bearing with a second end face against an end of a valve stem, the tappet comprising a cup shaped housing (1) comprised of a hollow cylindrical wall (2) closed at one end by an end member (3) against the outside of which the cam abuts and a cylindrical guide sleeve (6) concentric with the cylindrical wall (2) and arranged at its end away from said end member (3) in the center of an annular flange element (5) which at its outer circumference merges into the cylindrical wall (2) of the housing (1) and guide sleeve (6) is spaced at an opposite end from said end member (3), a self-adjusting hydraulic play compensating element (10) being guided for longitudinal movement inthe guide sleeve (6) and comprising an inner piston (12) and an outer piston (11) slidingly receiving the inner piston (12), the two pistons telescoping and defining oil pressure chamber (22) which communicates through a bore in the inner piston (12) closed by a check valve (21) with a central oil reservoir (13) disposed in inner piston (12) defined by the inner surface (15) of said end member (3) and a wall of inner piston (12) which abuts against the inner surface (15), the outer piston (11) is mounted for longitudinal movement in the guide sleeve (6) and abuts at its closed end against the end of the valve stem, an annular oil reservoir (20) defined by said hollow cylindrical wall (2), said guide sleeve (6), said hydraulic play compensating element (10), said end member (3) and said flange element (5) and supplied with oil from outside said reservoir through a bore, a sleeve (17) beginning from said end member (3) is sealed where it abuts said end member against said oil reservoir (20) and engages the outer surface of said guide sleeve (6) and extends close to flange element (5), characterized in that a longitudinal channel (19) is formed at a single region between the sleeve (17) and the guide sleeve (6) to permit oil transfer from said annular oil reservoir (20) into the annular space (16) defined by said sleeve (17) and said inner piston (12).

2. The valve tappet of claim 1 wherein sleeve (17) is in the form of a pipe section open on both ends with one end abutting the end member (3) and sealingly secured thereto.

3. The valve tappet of claim 1 wherein sleeve (17) is in the form of a pipe section with a bottom (24) closing one side abutting the inner surface (15) of end member (3) of the housing (1).

4. The valve tappet of claim 1 wherein sleeve (17) engages an outer surface of guide sleeve (6) and is provided at a point of its circumference with a trough-like formation (18) extending in a longitudinal direction to define with guide sleeve (6) the longitudinal channel (19).

* * * * *